US005192077A

United States Patent [19]

Caicedo

[11] Patent Number: 5,192,077

[45] Date of Patent: Mar. 9, 1993

[54] FRACTION ILLUSTRATING POLYHEDRON

[75] Inventor: Oswald A. Caicedo, New Milford, N.J.

[73] Assignee: Sylvia Caicedo, N.J.

[21] Appl. No.: 904,826

[22] Filed: Jun. 26, 1992

[51] Int. Cl.[5] ..... A63H 33/10

[52] U.S. Cl. ..... 273/155; 434/196

[58] Field of Search ..... 273/153 R, 155, 157 R, 273/160; 434/96, 195, 196, 403

[56] References Cited

U.S. PATENT DOCUMENTS

| | | | |
|---|---|---|---|
| 2,826,829 | 3/1958 | Koons | 434/196 |
| 3,171,217 | 3/1965 | Birdsall | 434/196 |
| 3,201,894 | 8/1965 | Resch | 434/403 X |
| 3,596,396 | 8/1971 | Thomson | 273/155 X |
| 3,628,261 | 12/1971 | Thompson | 273/155 X |
| 3,638,949 | 2/1972 | Thompson | 273/160 X |
| 3,655,201 | 4/1972 | Nichols | 273/155 X |
| 4,037,846 | 7/1977 | Zeeman . | |
| 4,308,016 | 12/1981 | White | 434/403 X |
| 4,409,750 | 10/1983 | Silbermintz . | |
| 4,511,144 | 4/1985 | Roberts . | |
| 4,573,683 | 3/1986 | Lamie et al. . | |
| 4,809,980 | 3/1989 | Bertrand . | |
| 4,875,681 | 10/1989 | Ofir | 273/155 |

FOREIGN PATENT DOCUMENTS

| | | | |
|---|---|---|---|
| 1417901 | 8/1988 | U.S.S.R. | 273/155 |

*Primary Examiner*—V. Millin

*Assistant Examiner*—William E. Stoll

*Attorney, Agent, or Firm*—Ostrolenk, Faber, Gerb & Soffen

[57] ABSTRACT

A polyhedron with indicia carrying sections, for example a cube. The polyhedron is comprised of a first plurality of first larger sections, e.g. two halves of the cube, and the two larger sections are hinged together along neighboring edges. Their abutting, opposed surfaces, are hidden from view. When the larger sections are opened apart, this exposes indicia, e.g. a fraction, indicative of the portion of the whole polyhedron which each fractional larger sections comprises. Each of the larger sections of the polyhedron, e.g. a cube, are in turn openable apart around hinges to define smaller sections of the larger section. Surfaces of the hinged together smaller sections, which are hidden from view when the smaller sections are assembled, are exposed to view when the smaller sections are opened apart to define still smaller sections. Those indicia are related to the size of the smaller sections and, e.g., recite the fraction of the whole polyhedron which those smaller sections comprise. The opening apart sequence may continue with each smaller section being openable apart into a respective set of still smaller sections, etc. The hinges between any two sections of the cube are along their neighboring edges. The polyhedron may have any shape and the individual sections, smaller sections, etc. may be any number of smaller sections which together define the larger section or polyhedron.

8 Claims, 2 Drawing Sheets

FRACTION ILLUSTRATING POLYHEDRON

BACKGROUND OF THE INVENTION

The present invention relates to a polyhedron comprised of a plurality of larger first sections, which are openable apart to define smaller second sections, and the second sections are openable apart to define still smaller third sections The sections may be marked with indicia relating to the part of the entire polyhedron which each individual section comprises. The invention could have use as an educational device to illustrate fractions of the entire polyhedron or to illustrate a complete whole comprised of a plurality of parts somehow related to parts of the polyhedron, e.g. a calendar, and it may be used for entertainment and amusement as well.

Various polyhedrons, such as cubes, are shown in the art as being made up of separate parts or sections See U.S. Pat. No(s). 4,573,683 and 4,037,846. It is known to have separate sections of a polyhedron connected together and openable apart around their respective connections together. See U.S. Pat. No. 4,409,750. In addition, the individual parts of such a polyhedron may be marked with indicia, which are hidden from view when the polyhedron is assembled, but which are exposed to view when the sections of the polyhedron are moved, e.g. by being folded outward. See U.S. Pat. No(s). 4,409,750; 3,638,949; 4,509,980. See also U.S. Pat. No. 4,511,144. It is also known to have the indicia represent something related to a part of a whole, e.g. a number, a calendar date, etc.

However, the prior art does not suggest a polyhedron which has openable apart, yet attached together, sections that carry indicia related to the fraction of the entire polyhedron that an individual section thereof comprises. Furthermore, the prior art does not suggest a series of opening steps for first opening the first larger sections of the polyhedron apart to define second smaller sections and for then opening each of the second smaller sections apart to define third still smaller sections, etc.

SUMMARY OF THE INVENTION

The primary object of the invention is to provide a polyhedron which is openable apart into sections and which provides an indication of the portion of the entire polyhedron which an individual section thereof comprises.

It is another object of the present invention to provide a polyhedron which illustrates fractions.

A further object of the invention is to provide a polyhedron which will afford education, information, entertainment and/or amusement to the user.

Stated broadly, the present invention comprises a polyhedron comprised of first larger sections which bear indicia that indicate or are related to the fraction or portion of the whole polyhedron which each of the individual first sections comprises. The fraction may be an actual fractional number or it may be a normally fractionated concept, such as a month or day on a calendar, or parts of a task completed, etc. The first larger sections of the polyhedron are attached together and when they are assembled into the polyhedron, their indicia are hidden from view. The first sections are openable apart which exposes their indicia. At least some of the larger first sections of the polyhedron are openable apart to define smaller second sections and some of the smaller second sections may in turn be openable apart to define even smaller third sections, etc. The smaller second and still smaller third sections also carry respective indicia related to their fraction or portion of the whole polyhedron.

The present invention is illustrated and described herein in conjunction with a cube which is comprised of first larger sections, the neighboring ones of which are pivotally fastened together, and the larger first sections are openable apart to define smaller second sections, the neighboring ones of which are pivotally fastened together, and the second sections are openable apart to define still smaller third sections. In a simple example for illustration, the cube is so divided and the cube sections are so shaped and divided as to illustrate arithmetic powers of one half $\frac{1}{2}$ (larger sections), $\frac{1}{4}$ (smaller sections), $\frac{1}{8}$ (still smaller sections). A cube may be sectioned to illustrate other fractions, such as $\frac{1}{3}$ and multiples of $\frac{1}{3}$, etc. The cube is openable in at least two stages in sequence, first from the full cube to a first set of larger sections of the entire cube and then at least some of the larger sections are openable in a second stage into a second set of smaller sections. A third set of still smaller sections can be similarly formed from the smaller sections in a third opening stage.

Furthermore, polyhedrons of other shapes than a six sided cube may be provided, e.g. pyramid shape, a ten sided polyhedron, or another regular or irregular shaped polyhedron. There is, hypothetically at least, no limit to the variety of shapes of polyhedron or the fractional sections, smaller sections, etc. thereof into which the polyhedron may be divided or separated.

Each section of the polyhedron is connected to at least one other section at the same stage in the opening sequence, e.g. the other smaller sections. The connections are at respective swing or pivot hinges between sections, so that the sections connected at each hinge can swing apart around the hinge to expose normally hidden surfaces on the neighboring opposed faces of the connected polyhedron sections and can swing back together again around the hinge to reassemble the whole polyhedron. The sections of the polyhedron are hinge connected at their edges and/or corners.

For example, the cube shaped polyhedron may be opened out in a series of opening steps to illustrate fractions that are multiples of $\frac{1}{2}$. The assembled cube may have indicia on its external surfaces. The cube can be separated into two half cubes, where the cube is split in half either through the center of two sets of opposite side thereof or on a diagonal between opposite corners. The two sections of the cube are held together by a hinge at adjacent edges along one side or along one of the corners of each section. When the previously abutting surfaces of the two half cube sections are exposed to view, each of the previously neighboring opposed, in this case abutting, surfaces of the two sections are seen to be carrying previously hidden from view indicia, such as the fraction $\frac{1}{2}$. This illustrates that each cube section is one $\frac{1}{2}$ of the whole.

Each $\frac{1}{2}$ cube section is itself comprised of two smaller sections connected by a hinge along adjacent edges of the two smaller sections. When the two sections of the $\frac{1}{2}$ cube are separated around their hinge, previously hidden neighboring, opposed abutting surfaces of the two sections of the $\frac{1}{2}$ cube are exposed to view. Each carries indicia, such as the fraction $\frac{1}{4}$. That 5 indicates that the cube part in the second stage in the opening sequence is ¼ of the entire cube and also illustrates the concept of the fraction ¼.

The ¼ cube section may be comprised of two equal size still smaller sections which are also connected together by a hinge at their adjacent edges, so that those two still smaller sections may be separated around their hinge to expose previously hidden, neighboring, opposed surfaces marked with the indicia ⅛. This process could of course be continued.

The foregoing description was premised on each section of the cube in turn being separable into two equal sections. Any selected section of the cube could be divisible into other than two sections, e.g. into three equal sections. When two adjacent sections are separated, their previously hidden, neighboring, opposed surfaces could indicate their fraction of the whole assembled polyhedron. For example, if one half of a cube is separable into three equal smaller sections, rather than into two sections, when two of the three smaller sections of the one half cube are separated so that their previously hidden, neighboring, opposed surfaces are exposed, each surface may carry the indicia 1/6, since each of those sections comprises 1/6 of the entire cube. Other ways of fractionating a cube should be apparent from the above illustrations. Similarly, the cube itself or any section thereof need not be initially divisible into only two or three sections, but may be divisible into five sections, etc. Correspondingly, any other polyhedron may be separable into various numbers of sections in any number of opening stages.

Other objects and features of the present invention will become apparent from the following description of a preferred embodiment of invention considered in conjunction with the accompanying drawings.

DESCRIPTION OF PREFERRED EMBODIMENTS

Figure 1:
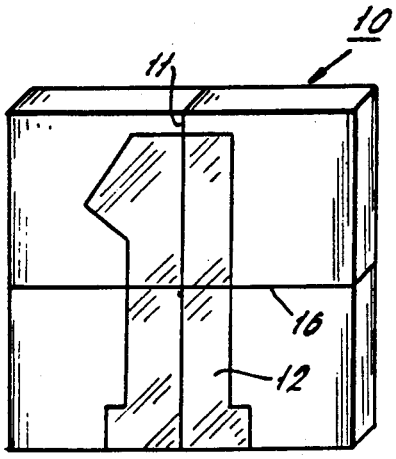
FIG. 1 is a front perspective view of a cube shaped polyhedron still assembled.

FIGS. 1–6 illustrate a polyhedron in the form of a cube 10 in which the invention is practiced. The cube 10 is a complete six sided polyhedron. At least some of its exterior sides are marked with indicium 12 in the form of the number "1", and the complete cube illustrates the concept of a single whole. As can be seen in FIG. 1, the cube is not a one piece structure, but it is divided midway its width at division 14 and midway its height at division 16.

Figure 2:
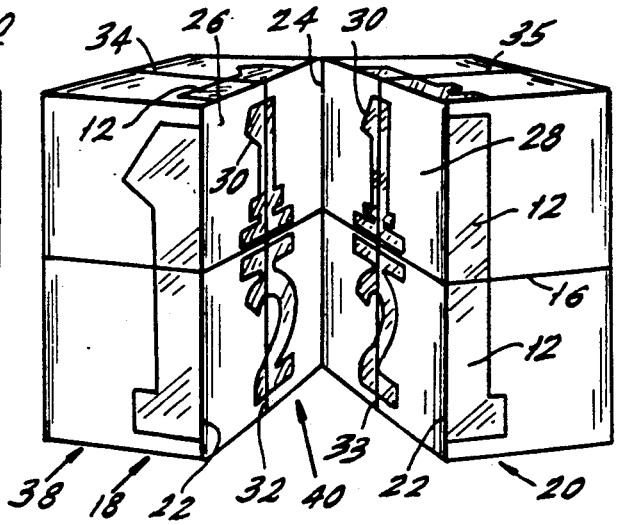
FIG. 2 is a view of that cube partially opened apart into two larger sections.
Figure 6:
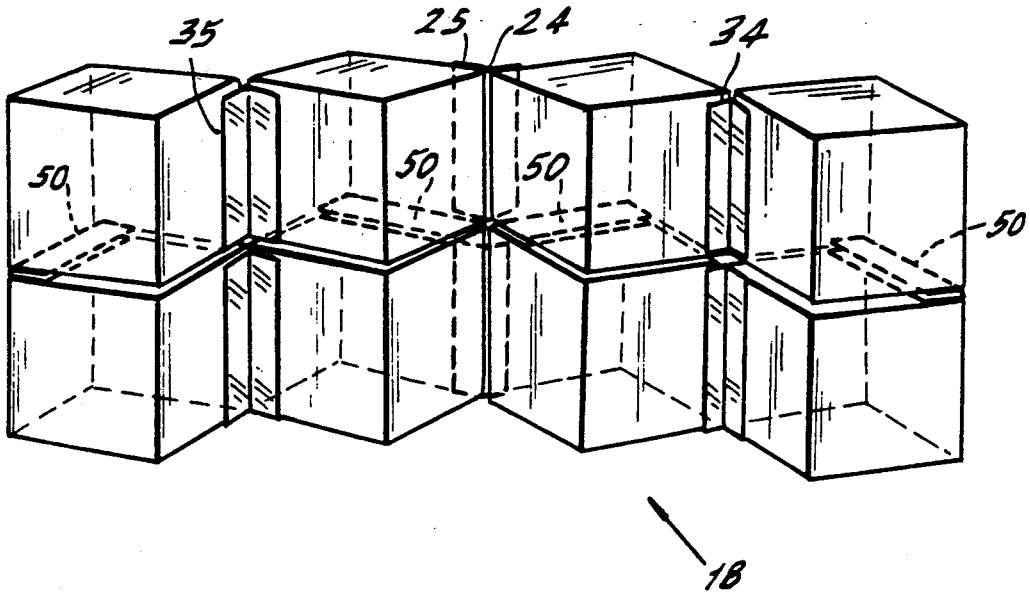
FIG. 6 is a rear view of the cube in the condition of FIG. 4, particularly illustrating attachment together of the cube sections.

FIG. 2 shows the entire cube 10 opened up into two ½ cube, larger sections 18 and 20. The two sections have front vertical edges 22 which are opened apart and rear vertical edges 24 at which there is defined a hinge around which the sections 18 and 20 are opened apart and together. In FIG. 6, the hinge 25 between larger sections 18 and 20 can be seen as comprising a film like strip of a flexible thermoplastic material but any other hinge may be used. The hinge 25 is along one abutting edge 24 of each of the two sections 18 and 20, so that the sections 18, 20 can be hingedly pivoted apart and pivoted together again to reassemble the entire cube 10.

Each of the sections 18 and 20 has a respective side 26, 28, and the sides 26, 28 are facing opposed sides which are also abutting. When the cube is assembled as in FIG. 1, both sides 26, 28 are hidden. When the sections 18, 20 are opened apart around the hinge 25, as in FIG. 2, the sides 26, 28 are both exposed to view. Each side 26, 28 is marked with the same indicia 30, in the form of the fraction "½", which is proportional to the part of the entire cube 10 which each of the sections 18, 20 comprises.

Figure 3:
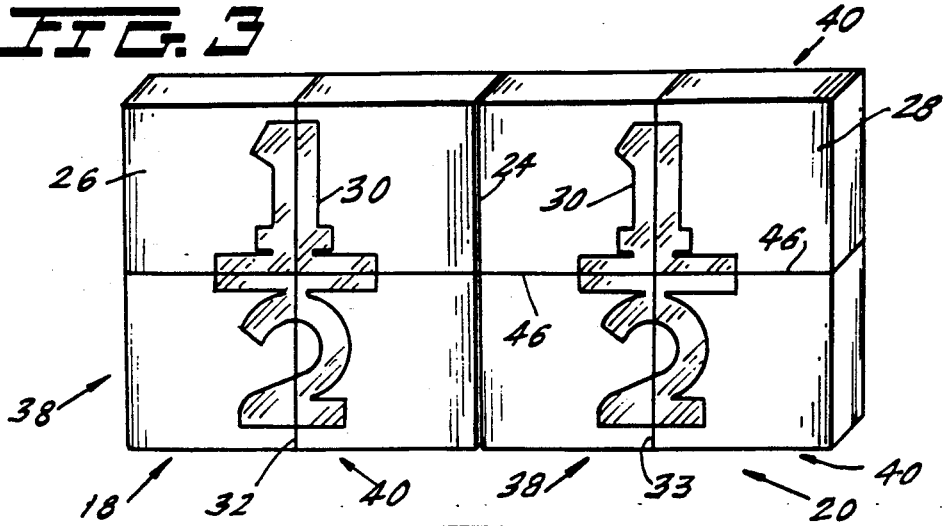
FIG. 3 is a front perspective view of that cube with the larger sections fully opened apart.
Figure 4:
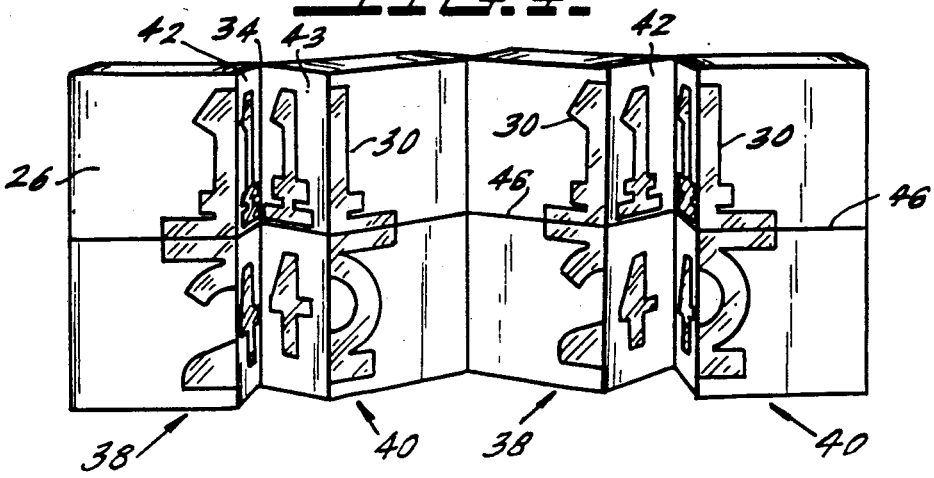
FIG. 4 is a front perspective view of that cube with the opened apart larger sections, in turn, opened apart into smaller sections.

In FIGS. 2 and 3 each larger section 18, 20 is separated at a respective vertical separation line 32, 33 located midway across its previously hidden from view, now exposed to view surface 26, 28. Each section 18, 20 is openable apart around a respective rear hinge 34, 35, which is similar in type to the respective hinges between the two sections 18, 20. Each larger section 18, 20 is openable apart into two smaller sections 38, 40 by pivoting the sections 38, 40 apart around their hinges 34, 35, as shown in FIG. 4. Each smaller section is ¼ of the cube 10. Although both of the ½ sections 18, 20 are shown as separable into respective smaller sections 38, 40, alternatively, only one of the sections 18 or 20 may be openable apart while the other is not.

Each of the smaller sections 38, 40 of each of the larger ½ sections 18, 20, has a respective facing opposed side 42, 43, which faces the opposed side of the other smaller section 38, 40. The sides 42, 43 are hidden from view when the smaller sections 38, 40 are assembled together to define the respective larger sections 18, 20. When the sections 38, 40 are opened apart around the hinges 34, 35, the previously hidden from view sides 42, 43 are visible. Each of the sides 42, 43 may have indicia 44 imprinted on it, which is indicative of the portion of the entire cube which the section 38, 40 comprises, here ¼. There have now been two stages of opening up of sections, from the complete cube 10, to the first series of larger sections 18, 20 to the second series of smaller sections 38, 40.

Figure 5:
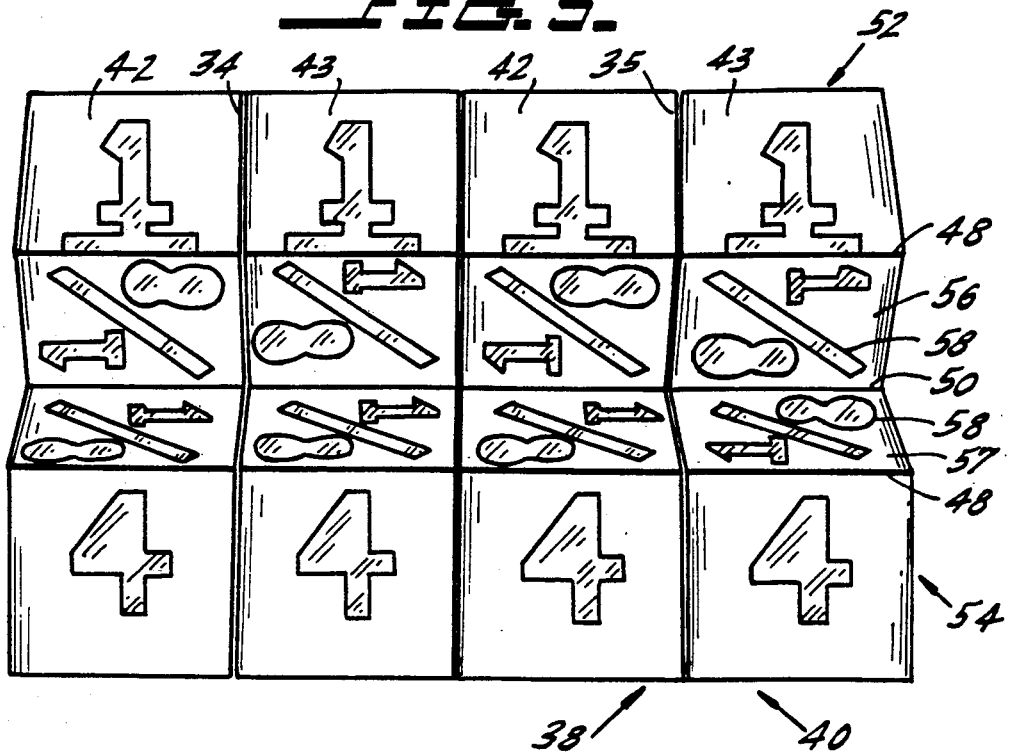
FIG. 5 is a front perspective view of that cube with the smaller sections also opened apart into still smaller sections.

In FIGS. 3 and 4, there is also a horizontally extending slit opening 46 in each of the sections 38, 40. In FIG. 5, the individual smaller sections 38, 40 are openable apart at the slit opening 46, so that the front edge 48 of each of the smaller sections 38, 40 is separable apart, around the hingedly connected rear edges 50 of these sections to define respective still smaller sections 52, 54 for each of the smaller sections, 38, 40. Each of still smaller sections 52 and 54 has a respective facing opposed surface 56, 57, and the surfaces 56, 57 are also abutting and hidden from view when the still smaller sections 52, 54 are together, as in FIG. 4. When the still smaller sections 52, 54 are opened apart, the previously hidden from view surfaces 56, 57 are exposed to view. Each of the surfaces 56, 57 carries indicia 58 which are indicative of the portion of the entire cube which the individual still smaller section 52, 54 comprises, here "⅛".

The fractional numbers which appear on the surfaces of the larger cube sections, the smaller sections and the still smaller sections are educational in that they teach a size or volume concept, and in the illustrative example, they teach the concept and mass of individual fractional sections of a cube.

Of course, other indicia may be used than number fractions. The individual sections of the polyhedron or cube may be divided into months, weeks and days of the week, for example, by appropriate sectioning and indicia marking of the polyhedron. There is no requirement that each larger section or smaller section of the cube be separable only into the same number of smaller sections or that all of the sections in a particular step in the opening apart sequence be of the same size or shape. Appropriately placed separations between sections can achieve various possibilities.

The arrangement illustrated in the preferred embodiment derives from a cube. But other shape polyhedrons may be also separable into individual sections. The sections need not be in powers of two but may be in multiples or powers of other numbers, and may be different numbers in each of the opening steps in the sequential series of opening steps. Also, it is not necessary that all of the sections, the smaller sections and/or the still smaller sections be openable apart, and fewer than all of them may be openable apart at each stage of the sequence.

The cube 10 illustrated above has all of its sections and subsections openable apart around hinges, as shown in FIG. 6. The hinges may be supplied by film material at the neighboring abutting edges of neighboring larger sections, smaller sections and still smaller sections. However, the sections in any stage of the opening apart sequence need not all be connected together at the same side or surface of every cube section, although that may be most convenient for application of the hinges. Some sections may be attached together along an edge extending along the rear side of the cube, while other sections may be attached together along a different edge, along the top, for example. It is only necessary that each section in any stage of the opening apart sequence be hinged to at least one other section in that stage, i.e. each smaller section should be hinged to a neighboring smaller section, etc., and the particular places at which they are hinged to each other are not specific requirements of the preferred embodiment.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A polyhedron with indicia carrying sections, comprising:

the polyhedron being comprised of a first plurality of first larger sections which may be assembled together to define the complete polyhedron;

a respective first hinge connecting between each of the first sections and at least another one of the first sections, the first hinge being placed on each first section such that the connected first sections may be assembled together and may be hingedly openable apart around the respective first hinge between them;

at least one of the connected first larger sections having a first surface which is hidden from view when the first sections are assembled together to define the polyhedron and the first surface is so placed on the first section and with respect to the first hinge as to be exposed to view when the first sections are opened apart;

indicia representative of the fraction of the entire polyhedron of which the first section is comprised being defined on the first surface;

at least one of the first sections being comprised of a respective second plurality of second smaller sections which, when the second sections of which the one first section is comprised are assembled together, the second plurality of second sections define the one first section;

a respective second hinge connecting between each of the second sections and at least another one of the second sections, the second hinge being placed on each second section such that the connected second sections may be assembled together and be hingedly openable apart around the respective second hinge between them;

at least one of the connected second sections having a second surface which is hidden from view when the second sections are assembled together to define the one first section and which is exposed to view when the second sections are opened apart;

indicia representative of the fraction of the entire polyhedron of which the second section is comprised being defined on the second surface.

2. The polyhedron of claim 1, wherein the first sections which are connected by the first hinge are neighboring first sections, and the first surface which is hidden from view on the one first section is an opposed facing surface facing a respective opposed facing surface of the other connected first section; and the second sections which are connected by the second hinge are neighboring second sections, and the second surface which is hidden from view on the one second section is an opposed facing surface facing a respective opposed facing surface of the other connected second section.

3. The polyhedron of claim 2, further comprising at least one of the second sections being comprised of a respective third plurality of third still smaller sections which, when the third sections of which the one second section is comprised are assembled together, the third plurality of third sections define the one second section;

a respective third hinge connecting between each of the third sections and at least another one of the third sections, the third hinge being placed on each third section connected by the third hinge such that the connected third sections may be assembled together and be hingedly openable apart around the respective third hinge between them;

at least one of the connected third sections having a third surface which is hidden from view when the third sections are assembled together to define the one second section and which is exposed to view when the third sections are opened apart;

indicia representative of the fraction of the entire polyhedron of which the third section is comprised being defined on the third surface.

4. The polyhedron of claim 2, wherein the first sections which are connected at a respective first hinge have respective neighboring first edges at and along which the first hinge is formed, whereby the connected first sections are openable apart and are moveable together by pivoting the connected first sections around the respective first hinge and the connected first edges; and the second sections which are connected at a respective second hinge have respective neighboring second edges at and along which the second hinge connection is formed, whereby the connected second sections are openable apart and are moveable together by pivoting the connected second sections around the respective second hinge and the connected second edges.

5. The polyhedron of claim 1, wherein the respective indicia on each of the first and the second surfaces and which are hidden from view is selected to be indicative of the fraction of the entire polyhedron of which each of the respective first and second sections is comprised.

6. The polyhedron of claim 1, wherein the polyhedron is a cube.

7. The polyhedron of claim 1, wherein the first sections are all equal size fractional sections of the polyhedron.

8. The polyhedron of claim 7, wherein the second sections are all equal size fractional sections of the respective first section of the polyhedron.

* * * * *